US009540915B2

(12) United States Patent
Thompson et al.

(10) Patent No.: US 9,540,915 B2
(45) Date of Patent: Jan. 10, 2017

(54) METHOD FOR IMPROVED GRAVITY DRAINAGE IN A HYDROCARBON FORMATION

(71) Applicant: Statoil Canada Limited, Calgary, Alberta (CA)

(72) Inventors: Scott Thompson, Calgary (CA); Halvor Kjørholt, Trondheim (NO); Jan Håvard Jøranson, Stavanger (NO)

(73) Assignee: STATOIL CANADA LIMITED, Calgary (CA)

( * ) Notice: Subject to any disclaimer, the term of this patent is extended or adjusted under 35 U.S.C. 154(b) by 201 days.

(21) Appl. No.: 14/031,980

(22) Filed: Sep. 19, 2013

(65) Prior Publication Data

US 2014/0076554 A1 Mar. 20, 2014

(30) Foreign Application Priority Data

Sep. 20, 2012 (CA) ..... 2790475

(51) Int. Cl.
*E21B 43/17* (2006.01)
*E21B 43/24* (2006.01)

(52) U.S. Cl.
CPC ..... *E21B 43/17* (2013.01); *E21B 43/2406* (2013.01)

(58) Field of Classification Search
USPC ..... 166/271, 272.3, 268, 272.7
See application file for complete search history.

(56) References Cited

U.S. PATENT DOCUMENTS

| | | | | |
|---|---|---|---|---|
| 3,029,732 | A * | 4/1962 | Greene | 102/310 |
| 2005/0252656 | A1 | 11/2005 | Maguire | |
| 2006/0000610 | A1* | 1/2006 | Farabee et al. | 166/281 |
| 2010/0206555 | A1* | 8/2010 | Menard et al. | 166/245 |
| 2012/0024528 | A1* | 2/2012 | Mytopher et al. | 166/298 |
| 2012/0061081 | A1 | 3/2012 | Sultenfuss et al. | |
| 2012/0193094 | A1* | 8/2012 | Arthur et al. | 166/272.3 |

* cited by examiner

*Primary Examiner* — Taras P Bemko
(74) *Attorney, Agent, or Firm* — Birch, Stewart, Kolasch & Birch, LLP

(57) ABSTRACT

The invention relates to a method for improved gravity drainage in a hydrocarbon formation, the method comprising: drilling a production well along a substantially horizontal production layer of a reservoir; drilling a perforation well above the production well, either in the production layer or in a layer separated from the production layer by a fluid barrier; perforating the formation adjacent the perforation well to provide a fluid flow path to or within the production layer; inducing gravity drainage through the fluid flow path; and producing fluids collected in the production well.

14 Claims, 4 Drawing Sheets

METHOD FOR IMPROVED GRAVITY DRAINAGE IN A HYDROCARBON FORMATION

FIELD OF THE INVENTION

This invention relates to a method for improved gravity drainage in a hydrocarbon formation. Particularly, but not exclusively, the invention relates to a method for more effectively utilising gravity drainage techniques, for example, Steam-Assisted Gravity Drainage (SAGD), in formations with layered reservoirs (i.e. having intervening layers of rock such as shale).

BACKGROUND TO THE INVENTION

Steam-Assisted Gravity Drainage (SAGD) is one technique used in enhanced oil recovery to extract bitumen, heavy or extra-heavy crude oil from a sub-surface formation. It usually comprises the drilling of two parallel horizontal wells with one positioned about 4 to 6 meters above the other. The upper well constitutes an injection well configured to inject high pressure steam into the formation to heat the oil and reduce its viscosity. The heated oil then flows more easily to the lower well, under the action of gravity. The lower well constitutes a production well which collects the heated oil and any water resulting from condensation of the injected steam, and transports this to the surface. Commonly, an artificial lift device, such as an electrical submersible pump (ESP), will be employed to help flow the fluids to the surface.

However, traditional SAGD depends on relatively thick and homogeneous reservoirs for economical drainage. A reservoir which is split into two or more layers separated with horizontal (or near horizontal) rock (e.g. shale) barriers is not likely to be economically producible with traditional SAGD since it would require drilling two wells into each reservoir layer, one for each of the injection and production wells.

It is therefore an aim of the present invention to provide a method for improved gravity drainage, which addresses the afore-mentioned problems.

SUMMARY OF THE INVENTION

According to a first aspect of the present invention there is provided a method for improved gravity drainage in a hydrocarbon formation, the method comprising: drilling a production well along a substantially horizontal production layer of a reservoir; drilling a perforation well above the production well, either in the production layer or in a layer separated from the production layer by a fluid barrier; perforating the formation adjacent the perforation well to provide a fluid flow path to or within the production layer; inducing gravity drainage through the fluid flow path; and producing fluids collected in the production well.

Embodiments of the present invention therefore provide an improved gravity drainage method which can be applied to stacked reservoirs to drain them more economically since the fluids are allowed to flow between (normally near horizontal) layers, through the fluid flow paths provided by the perforations, thus reducing the number of individual wells that are required to be drilled. The fact that fewer wells are required to be drilled also reduces the time between commencing the project and starting production thereby saving costs and making lower quality reservoirs more economically attractive. In the case where the perforations are created within a single layer, the step of perforating the formation adjacent the perforation well may help to speed up the step of inducing gravity drainage by, for example, speeding up the transport of steam into the reservoir to therefore heat the fluids in the reservoir more quickly.

The formation may comprise a stacked (i.e. stratified) reservoir having multiple layers with intermediate fluid barriers. The formation may be constituted, for example, by an oil sand formation or a carbonate rock formation. The fluid barriers may comprise substantially impermeable rock, breccia, shale, mud (i.e. Inclined Heterolithic Strata HIS), or mudstones. For example, the fluid barriers may comprise a combination of relatively thin mud layers that cumulatively form a barrier that is between 0.5 m and 2 m thick. Although, in some cases, the fluid barriers may extend along the full horizontal extent of the reservoir, in other cases, the fluid barriers may only be present in a particular area of the reservoir and may include one or more gaps therein.

The perforation well may be disposed adjacent (e.g. as close as practically possible to) a fluid barrier such that the step of perforating the formation adjacent the perforation well provides fluid flow paths through the fluid barrier. In practice, the perforation well may be positioned within approximately 1 m from the fluid barrier. The perforation well may be positioned within, above and/or below the fluid barrier and the perforations may be directed (downwardly or upwardly) through the perforation well to penetrate the fluid barrier.

Some embodiments may further comprise the step of perforating the formation adjacent the production well, prior to producing fluids collected in the production well. This step may be performed prior to lining the production well when it has been drilled, either intentionally or unintentionally, through or below a fluid barrier near the bottom of a production zone in order to provide fluid flow paths down into the producer.

The step of perforating the formation may comprise creating perforations having a spatial frequency along the perforation well of about 0.1 to 2 or 1 to 5 perforations per foot (0.3048 m). The perforations may be created along one or more common radii. For example, where the perforation well is disposed between an upper and a lower fluid barrier, perforations may be created both upwardly and downwardly at each position along the perforation well.

The applicants believe that it will be possible to penetrate fluid barriers (e.g. shale layers) of up to approximately 2 m in thickness.

A plurality of production wells may be provided within the production layer (e.g. horizontally spaced apart). A plurality of perforation wells may also be provided (e.g. horizontally spaced apart).

The production wells may be vertically below the perforation wells or may be laterally offset (e.g. at a position midway between adjacent perforation wells) but at a greater depth than the perforation wells.

In embodiments of the invention, the gravity drainage technique employed may comprise one or more of SAGD, use of a solvent, use of electricity and use of heat. Thus, the step of inducing gravity drainage may comprise injecting steam, solvent, electricity or heat into the formation. The step of inducing gravity drainage may be performed by one or more injectors.

The perforation wells or other selected wells may be employed as injectors for the distribution of steam/solvent/electricity/heat to the reservoir. Perforation wells not employed as injectors will not be used for the distribution of steam etc but the perforations extending from these wells will remain as fluid flow paths for steam etc and bitumen to flow through the fluid barrier (in the vertical direction). Further injectors may be provided in one or more reservoir layers. The injectors in one layer may be vertically aligned or laterally offset with the injectors in another layer and/or the perforation wells and/or the production wells. A plurality of injectors may be provided in one or each layer (e.g. horizontally spaced apart).

In some embodiments, the production well may house a combined injector and producer (which is often referred to as single well SAGD) to further reduce the number of separate wells required.

In a particular embodiment, the formation comprises a first upper reservoir layer, a second lower reservoir layer and an intermediate fluid barrier. The perforation well (which may be configured as an injection well) is provided in the upper layer and the production well is provided in the lower (production) layer. An injection well may be provided in the lower layer, above the production well to form a standard SAGD arrangement in the lower layer. Alternatively, an injector may be combined with the production well to form a single well SAGD construction. Perforations are formed through the intermediate fluid barrier adjacent the perforation well. Steam/solvent/electricity or heat may then be injected through the injector in the perforation well and into the upper layer. Such injection induces the hydrocarbons (e.g. bitumen/heavy oil) in the upper layer to loose viscosity and flow downwardly under the action of gravity such that it will flow through the perforations in the fluid barrier and into the lower well below whereupon it is collected and transported to the surface via the production well. It is believed that gravity will be sufficient to allow the fluids to flow into the lower well. However, if necessary, the pressures in the layers of the reservoir may be altered so as to assist in the gravity drainage. It will be understood that steam/solvent/electricity or heat may also be injected through the injection well or single well SAGD construction to melt the hydrocarbons in the lower layer also.

It will be understood that an assessment may be necessary to determine optimal geometrical well arrangements and optimal starting times for each injector in the upper layers of a formation relative to the lower layers. More specifically, optimizing the well configuration will need to consider pre-heating of the well, e.g., heating of the oil sand formation between the injector and producer via steam circulation. If the fluid barrier is between the injector and producer such that they are significantly more than 5 m apart, then a further production and/or injection well may be required. Also, injection pressure in each injector and possible start and stop sequences may be determined to optimize production efficiency (e.g. if in practice it is difficult to achieve continuous counter flow of steam (up) and production fluid (down) through the fluid flow paths created by the perforations) and secure efficient transport of fluids from upper layers down to the producers at the base of the reservoir.

The step of perforating the formation adjacent the perforation well may be performed in open hole (i.e. after the perforation well has been drilled but before the perforation well has been lined). Alternatively, the step of perforating the formation adjacent to the perforation well may be performed after the perforation well has been lined such that the perforations are created through the liner and into the formation. In certain embodiments, the liner may comprise a sand screen or slotted liner.

The step of perforating the formation may be performed using a perforating tool (e.g. gun or downhole drilling tool). Each perforation may be created by an explosive charge.

It should be noted that common perforating practices involve setting a perforating gun inside a metal casing or liner string and creating perforations over an interval of interest so as to connect the wellbore to a reservoir. Perforations can be created by "jet perforating" or "bullet perforating". Conventional jet perforating comprises igniting a charge, which creates a high pressure, high velocity jet that moves radially outward producing a hole in the casing/liner, cement, and formation. The energy released from the explosive charge is dissipated in a number of ways, including: material removal and deformation of the casing/liner, cement, and formation. Energy release may also occur in the form of sound, pressure waves, and elastic deformation of the gun holder and casing/liner wall. Bullet perforating comprises the use of a hardened steel bullet or projectile which is propelled by an explosive charge to create a tunnel through the casing/liner, cement, and formation. The bullet and associated debris are embedded at the end of the tunnel and for this reason jet perforating is often preferred although either method may be employed in embodiments of the present invention.

In embodiments of the invention, perforations may be created in the open hole of the perforation wells, prior to installing a liner pipe in a horizontal section of the well. When the perforations are created in open hole, many benefits are achieved. Firstly, energy released from the perforation charge is not lost to perforating the liner (since the liner is not present during perforating). This allows a maximum amount of explosive energy to be used for extending the penetration depth, and/or allocating the maximum available energy to impact and penetrate mudstones, shales, or other fluid barriers that will impede steam and hydrocarbon flow and ultimately reduce the gravity drainage recovery efficiency. Therefore, this method provides incremental penetration depth compared to perforating first through a liner before perforating the formation. Secondly, perforations can be created without affecting the sand control ability of the liner (since perforations are created prior to installing the liner). This enables perforations to be created in any radial direction, which could be particularly useful for perforating oil sands zones with shale fluid barriers located vertically above or below the injection well. Thirdly, perforations can be created without affecting the structural load capacity of the liner. Adding perforations to the liner reduces the load capacity of the liner, so this is avoided by perforating prior to the liner being installed.

In order for open hole perforating to be successful, the fall back of bitumen and sand into the open hole should be minimal after the perforation is created. Bitumen will tend to hold sand grains together since bitumen exists at a very viscous state (e.g., 100000 cP) at virgin reservoir conditions (e.g., 10° C., 2500 kPa) and encompasses 75-85% (by volume) of the pore space. Furthermore, industry success in drilling through soft oil sand formations and installing liners of 1000 m in length indicates good open hole stability and suggests the open hole could remain intact after perforating. In case some amount of fall back does occur, an open hole clean out procedure could be implemented.

The method may therefore further comprise cleaning the perforation well after or during the step of perforating the formation. For example, the perforating tool may be fitted with a cleaning device arranged to clean the well as the perforating tool is operated from the toe of the well to the heel of the well. Alternatively, a cleaning procedure (e.g. wiper trip) may be performed after the perforating is complete and the perforating tool has been extracted from the well.

In certain embodiments, the perforating tool may remain in the perforation well after the perforations have been created. In which case, the perforation well may not be used for horizontal distribution of steam or production fluids but the perforations may remain as fluid flow paths for steam and production fluids to flow vertically through the fluid barrier from one layer to the next (i.e. steam or another form of injection may be via an injector that is not provided in the perforation well).

The injector may be constituted by the open hole of the perforation well. Alternatively, the perforation well may be lined with a perforated or slotted liner or similar (e.g. a liner comprising valves allowing steam to be injected into the formation) to form the injector. It will be noted that the provision of a such a liner may help to ensure and/or maintain hole stability as well as allowing for steam etc to be injected into the formation.

BRIEF DESCRIPTION OF THE DRAWINGS

Specific embodiments of the present invention will now be described with reference to the accompanying drawings, in which.

DETAILED DESCRIPTION OF CERTAIN EMBODIMENTS

Figure 1A:
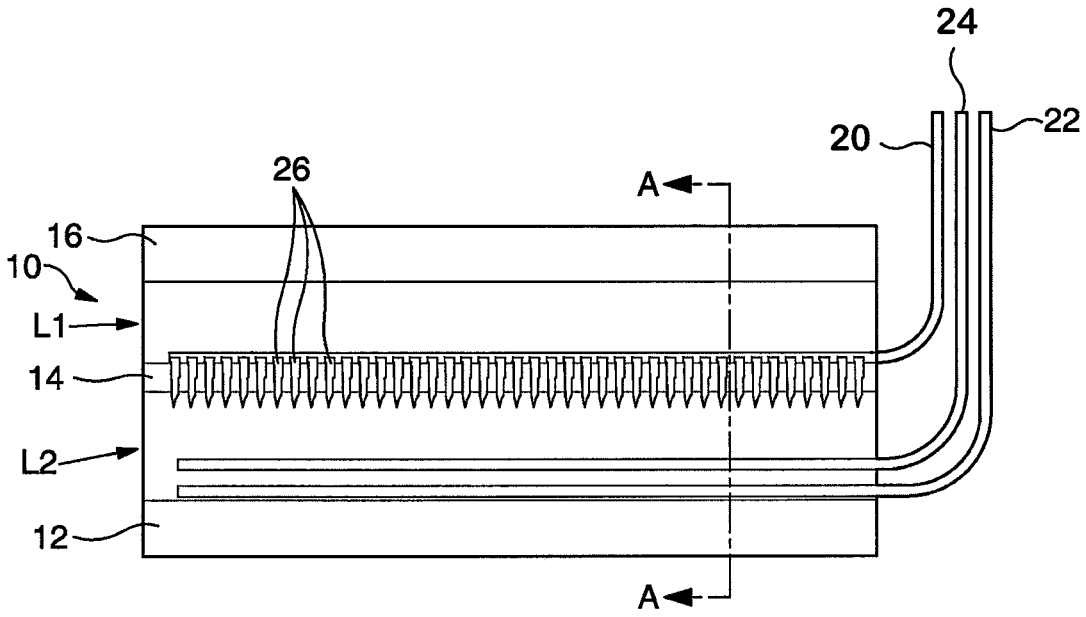
FIG. 1A shows a side view illustrating two reservoir layers in an oil sand formation with vertically aligned injectors provided in each layer and a vertically aligned producer provided in the lowest layer, the upper injectors are associated with perforations provided in an intermediate shale barrier between the layers so that fluid can flow down to the producer below.
Figure 1B:
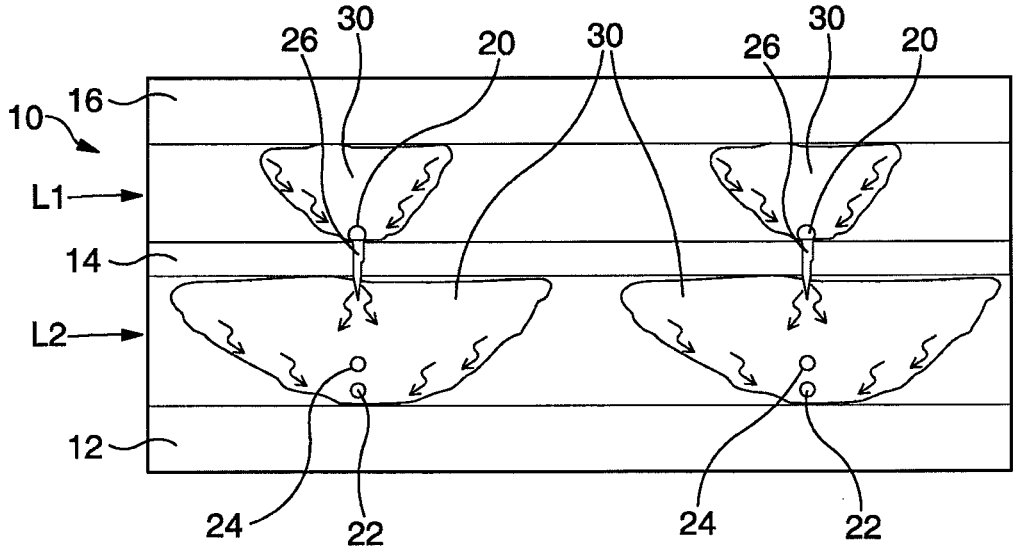
FIG. 1B shows an end cross-sectional view taken along line A-A in FIG. 1A showing a series of two horizontally aligned sets of the vertically aligned injectors, perforations and producers illustrated in FIG. 1A.

With reference to FIGS. 1A and 1B there is illustrated a method for improved gravity drainage (e.g. SAGD) in an oil sand formation 10 comprising two substantially horizontal reservoir layers (L1, L2) in accordance with a first embodiment of the present invention. As illustrated, the formation 10 comprises a base layer of rock 12 below the deeper (production) reservoir layer L2, a shale layer 14 forming an intermediate fluid barrier between the deeper reservoir layer L2 and the shallower reservoir layer L1, and a top layer of rock 16 above the shallower reservoir layer L1.

The method comprises drilling a production well 22 into the deeper reservoir layer L2 and drilling a perforation well 20 into the shallower reservoir layer L1. An injection well 24 is also drilled into the deeper reservoir layer L2, above the production well 22.

The perforation well 20 extends through the shallower reservoir layer L1 less than 1 m above the shale layer 14. After the perforation well 20 is lined with a liner (not shown), a perforating tool (not shown) is inserted into the perforation well 20 and a series of perforations 26 are created extending downwardly through the liner, the formation 10 and the shale layer 14. Each perforation 26 therefore provides a fluid flow path from the shallower reservoir layer L1 to the deeper reservoir layer L2.

As shown in FIG. 1B, the perforation well 22, perforations 26, injection well 24 and production well 22 are vertically aligned and the same arrangement is provided in multiple sets horizontally spaced along the formation 10.

After the perforations 26 are created in each of the perforation wells 20, the perforation tool is extracted and the well is configured as an injector. Steam 30 is then injected into the formation 10 through the perforation wells 20 and the injection wells 24. The steam 30 may be injected simultaneously through each well or the injection may be phased for maximum effect and efficiency. The steam 30 will rise and expand outwardly from each injector within each reservoir layer L1, L2. In the process, the steam 30 will cause hydrocarbons (e.g. bitumen) in the oil sand formation 10 to loose viscosity and flow generally downwardly under the action of gravity. Consequently, the hydrocarbons in the shallower reservoir layer L1 will flow through the perforations 26 in the shale layer 14 and into the deeper reservoir layer L2 whereupon they will be collected and transported to the surface via the production well 22.

Figure 2:
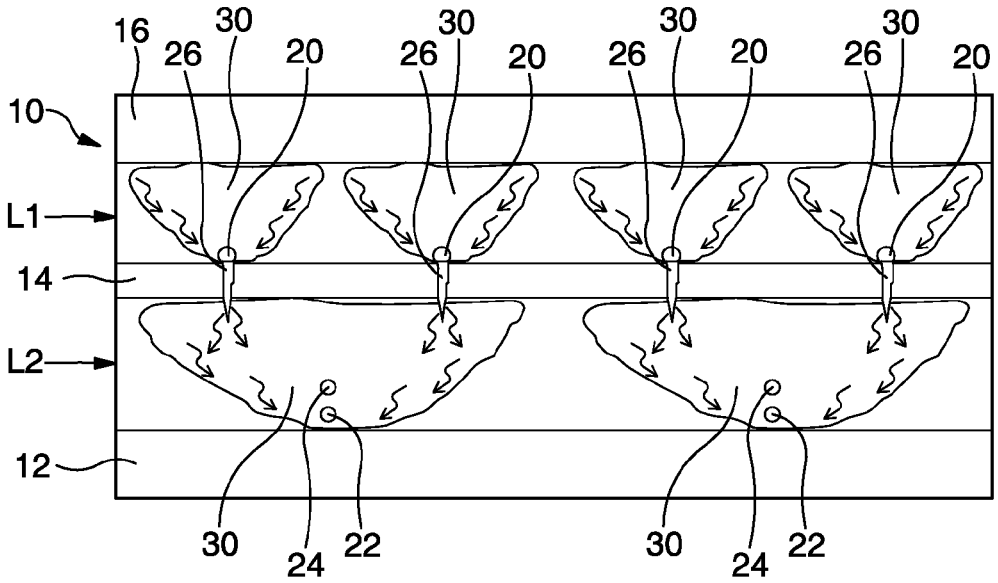
FIG. 2 shows an end cross-sectional view of an alternative arrangement wherein sets of two horizontally aligned injectors in an upper layer are configured to feed fluids through associated perforations to a central producer in a layer below, an injector is also provided in the layer below.

FIG. 2 shows an alternative arrangement which is similar to that of FIG. 1B but wherein sets of two horizontally aligned perforation wells 20 in the shallower reservoir layer L1 are arranged to cause fluids to flow through associated perforations 26 to a central production well 22 (midway between the two perforation wells 20) in the deeper reservoir layer L2 below. As before, an injection well 24 is provided above each production well 22 in the deeper reservoir layer L2.

Figure 3:
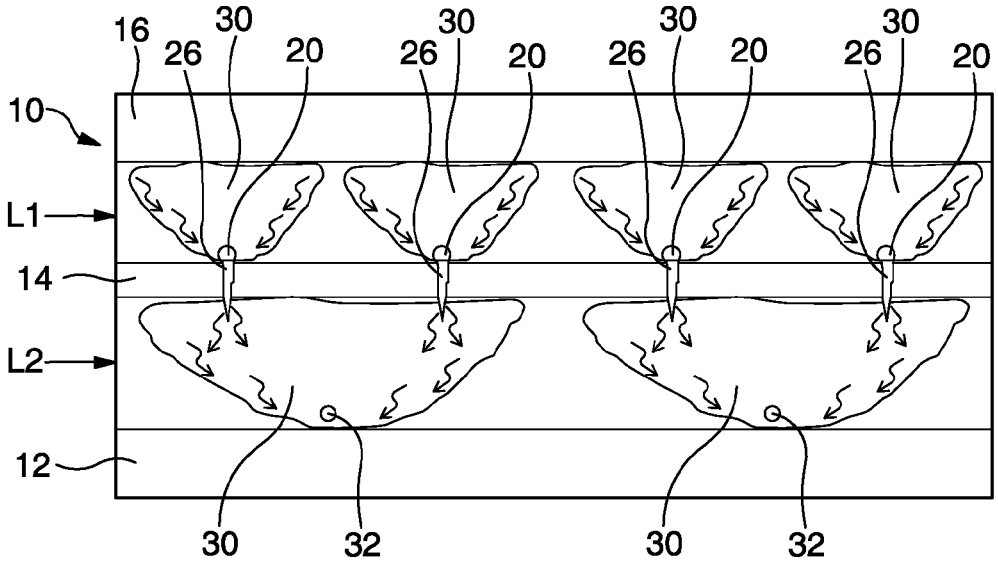
FIG. 3 shows an end cross-sectional view of a further arrangement wherein sets of two horizontally aligned injectors in an upper layer are configured to feed fluids through associated perforations to a central combined injector and producer in a layer below.

FIG. 3 shows a further arrangement which is similar to that of FIG. 2 but wherein the production wells are combined with the injection wells in the deeper reservoir layer L2 to form combined injector/producers 32.

Figure 4:
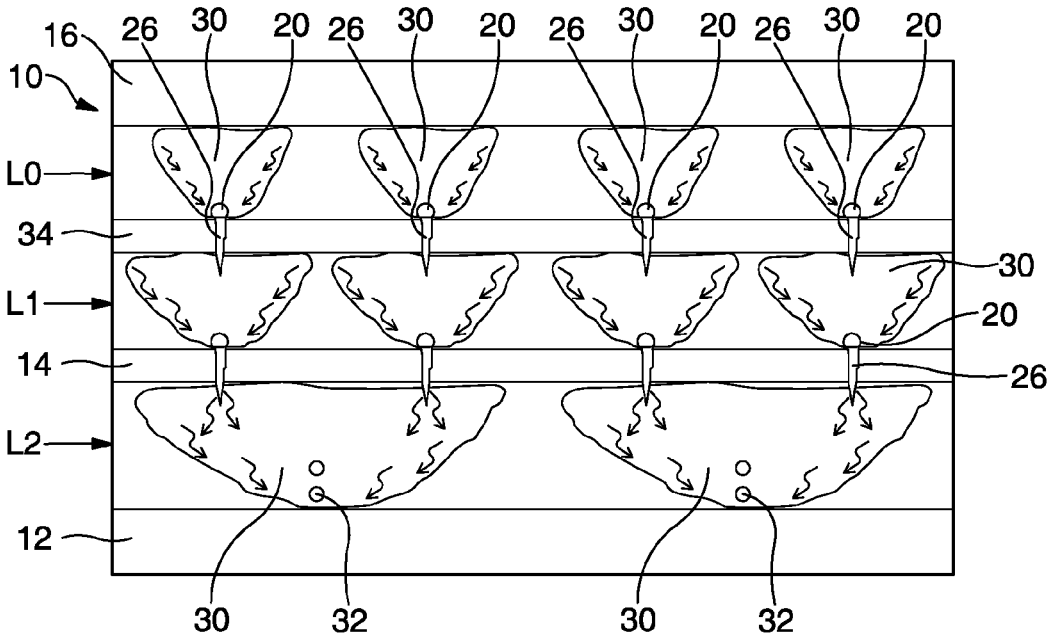
FIG. 4 shows an end cross-sectional view of another arrangement which essentially comprises the arrangement shown in FIG. 3 with a further reservoir layer above having further injectors and associated perforations vertically aligned with those in the layer immediately below.

FIG. 4 shows another arrangement which essentially comprises the arrangement shown in FIG. 3 with a further reservoir layer L0, which is shallower than reservoir layer L1 and separated from reservoir layer L1 by a further shale layer 34, having further perforation wells 20 and associated perforations 26 vertically aligned with those in the reservoir layer L1 immediately below. As illustrated, the further perforation wells 20 are configured as injectors to inject steam 30 into the further reservoir layer L0 to melt the bitumen therein and to allow it to flow through reservoir layer L1 and into reservoir layer L2, where it is transported to the surface via the injector/producers 32.

Figure 5:
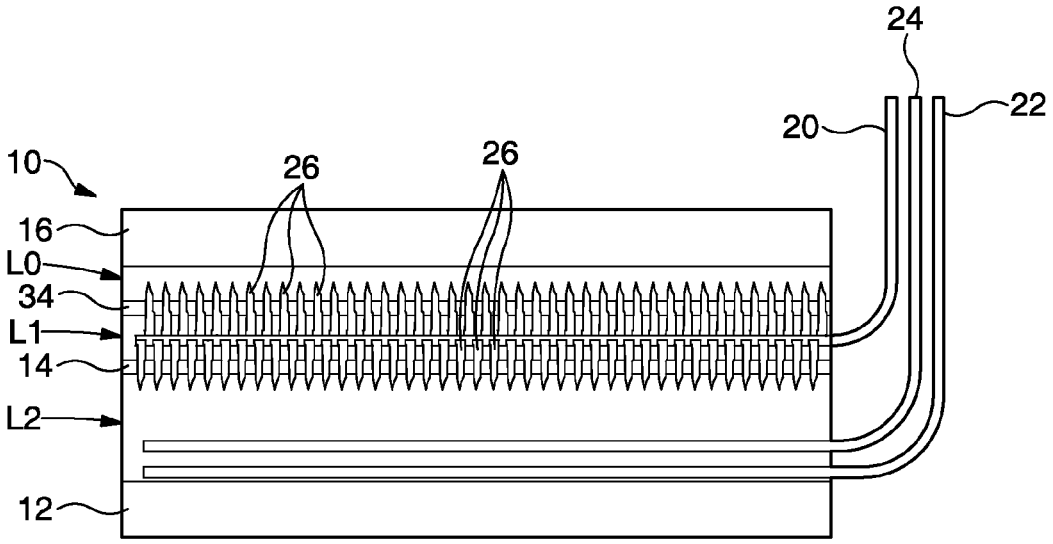
FIG. 5 shows a side view similar to that in FIG. 1A but wherein a further reservoir layer is provided above the uppermost layer in FIG. 1A and the injectors in the now middle layer are further associated with an upper set of perforations to allow fluid to flow down from the further reservoir layer above.

FIG. 5 shows a side view similar to that in FIG. 1A but wherein a further reservoir layer L0, which is shallower that reservoir layer L1 and separated from reservoir layer L1 by a further shale layer 34 as in FIG. 5. However, in this case no wells are drilled into the further reservoir layer L0. Instead, both upwardly directed and downwardly directed perforations 26 are created via the perforation wells 20 in the reservoir layer L1. In this case, the perforations 26 are formed by inserting a perforating tool (not shown) into the open hole of the perforation wells 20 (before they are lined) and utilising the perforating tool to create perforations 26 both upwardly and downwardly through the formation 10. As there is no liner present in the perforation wells 20, the perforations 26 can extend further into the formation 10 to perforate both the shale layer 14 below the reservoir layer L1 and the shale layer 34 above the reservoir layer L1. Although not shown, steam may be injected into the formation 10 via the perforation wells 20 and/or the injection wells 24 to melt the bitumen in the oil sands and to allow it to flow down from reservoir layer L0, through reservoir layer L1 and into reservoir layer L2, where it is transported to the surface via the production well 22.

As more energy can be transmitted to form deeper perforations 26 when they are created in open hole, embodiments of the invention can be economically employed even where relatively thick shale layers are encountered and/or where there are several relatively thin reservoir layers stacked together.

When the perforation tools can be retrieved from the wells, the wells can be lined and used as injectors. However, when the perforation tools cannot easily be retrieved from the wells, they may remain in the wells and the perforations may remain as vertical flow channels for the injected substances (e.g. steam) and the production fluids but the well itself will not be used for injection or for distributing the production fluids.

Figure 6:
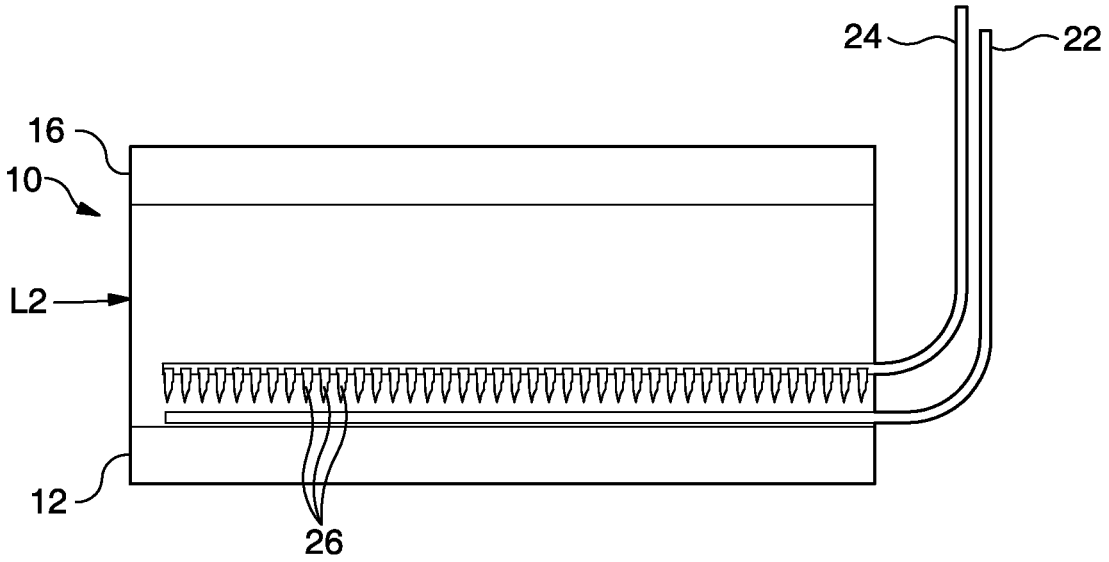
FIG. 6 shows a side view similar to that in FIG. 1A but wherein only a single, lower layer is present and the injector is configured to create perforations through the injector tubing and adjacent oil sand formation so as to reduce heat-up time upon commencement of a SAGD phase.

FIG. 6 shows a side view similar to that in FIG. 1A but wherein only the deeper reservoir layer L2 is present and the perforations 26 are created downwardly through the injection well 24 (after it has been lined) and into the oil sand formation 10 above the production well 22. The perforations 26 are advantageous in allowing injected steam to more quickly and effectively penetrate into the reservoir layer L2, thus reducing heat-up time upon commencement of a gravity drainage (e.g. SAGD) phase and therefore also reducing the time delay before hydrocarbons begin to flow into the production well 22. Such a perforating technique can be combined with standard heat-up by steam circulation, solvent soak or other methods. It will be noted that a preheating phase is commonly performed before gravity drainage (e.g. SAGD) can start so as to help to achieve fluid communication between an injector and a producer so that the melted bitumen can more easily reach the producer. By perforating the formation prior to the heat-up phase, the heat-up mechanism (e.g. steam or solvent soak) can penetrate more effectively and be more efficiently distributed within the formation between the two wells so as to shorten the effective distance between the producer and injector. In other words, the perforations serve to increase the contact area between the injected steam/solvent and the formation in-between the injector and producer, so that hydrocarbons in this area should mobilize more quickly.

Some embodiments of the invention comprise establishing standard SAGD in a lower reservoir layer in a stacked reservoir, either with use of a standard producer/injector configuration or by using a single well SAGD arrangement. One or more overlying layers in the formation are then drained by fluidly connecting them to the lower reservoir layer by drilling a perforation well closely above (or below) a fluid barrier and perforating through the fluid barrier. If the perforations are directed downwardly, the perforated wells may also be used as injectors.

It will be appreciated by persons skilled in the art that various modifications may be made to the above embodiments without departing from the scope of the present invention, as defined by the claims.

The invention claimed is:

1. A method for improved gravity drainage in a hydrocarbon formation, the method comprising:

drilling a production well through a first substantially horizontal production layer of a reservoir, wherein the production well is substantially horizontal and wherein the production layer comprises oil sand;

drilling a perforation well above the production well in a layer separated from the production layer by a fluid barrier, wherein the perforation well is substantially horizontal, wherein the perforation well is disposed adjacent the fluid barrier, wherein the layer comprises oil sand, and wherein the fluid barrier is substantially horizontal and comprises shale;

perforating the formation adjacent the perforation well and perforating said fluid barrier to provide perforations, which form a fluid flow path to the production layer, wherein the perforation well is positioned above the fluid barrier and the perforations are directed downwardly through the perforation well and through the fluid barrier and wherein each perforation extends vertically from the perforation well through the oil sand and through the fluid barrier;

inducing gravity drainage from the perforation well through the fluid flow path to the production well by injecting steam into the layer surrounding the perforation well to cause hydrocarbons in the oil sand formation to lose viscosity and flow through the fluid path provided by the perforations downwards under the action of gravity into the production well;

producing fluids collected in the production well;

wherein the formation is constituted by an oil sand formation comprising a stacked reservoir having multiple layers with intermediate fluid barriers, and wherein the step of perforating the formation adjacent the perforation well is performed radially outwards from the perforation well into the formation.

2. The method according to claim 1 wherein the step of perforating the formation comprises creating perforations having a spatial frequency along the first well of about 0.1 to 2 perforations per foot (0.3048 m).

3. The method according to claim 1 wherein the perforations are created along one or more common radii.

4. The method according to claim 1 wherein the perforation well is disposed within the fluid barrier or between an upper and a lower fluid barrier and the perforations are created both upwardly and downwardly at each position along the perforation well.

5. The method according to claim 1 wherein an injector is provided in at least one perforation well to induce gravity drainage through the fluid flow path.

6. The method according to claim 5 wherein further injectors are provided in one or more reservoir layers.

7. The method according to claim 6 wherein the injectors in one layer are vertically aligned with the injectors in another layer and/or the perforation wells and/or the production wells.

8. The method according to claim 6 wherein a plurality of horizontally spaced apart injectors is provided in one or each layer.

9. The method according to claim 1 wherein the production well houses a combined injector and producer.

10. The method according to claim 1 wherein the step of perforating the formation is performed using a perforating tool and each perforation is created by an explosive charge.

11. The method according to claim 10 further comprising cleaning the perforation well after or during the step of perforating the formation.

12. The method according to claim 11 wherein the perforating tool is fitted with a cleaning device arranged to clean the well as the perforating tool is operated from the toe of the well to the heel of the well.

13. The method according to claim 10 wherein the perforating tool remains in the perforation well after the perforations have been created and the perforation well and perforations serve as flow channels for steam and bitumen to flow through the fluid barrier from one layer to the next.

14. The method according to claim 1 wherein the perforation well is lined with a perforated or slotted liner, or a liner comprising valves allowing steam to be injected into the formation, to form the injector.

* * * * *